US008290628B2

(12) United States Patent
Yeo

(10) Patent No.: US 8,290,628 B2
(45) Date of Patent: Oct. 16, 2012

(54) AIR CONDITIONER AND METHOD FOR CONTROLLING THE SAME

(75) Inventor: Jongseob Yeo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 147 days.

(21) Appl. No.: 12/842,457

(22) Filed: Jul. 23, 2010

(65) Prior Publication Data

US 2012/0022703 A1 Jan. 26, 2012

(51) Int. Cl.
*G06F 19/00* (2011.01)

(52) U.S. Cl. ..... 700/277; 62/160; 62/180; 62/181

(58) Field of Classification Search ..... 700/277; 62/160, 180, 181
See application file for complete search history.

(56) References Cited

U.S. PATENT DOCUMENTS 4,644,756 A * 2/1987 Sugimoto et al. ..... 62/160
4,987,748 A * 1/1991 Meckler ..... 62/176.1
6,430,953 B2 * 8/2002 Roh ..... 62/231
6,792,323 B2 * 9/2004 Krzyzanowski et al. ..... 700/90
6,973,796 B2 * 12/2005 Park et al. ..... 62/160
7,163,156 B2 * 1/2007 Kates ..... 236/1 B
7,168,627 B2 * 1/2007 Kates ..... 236/1 B
7,455,237 B2 * 11/2008 Kates ..... 236/1 B
2003/0233201 A1 * 12/2003 Horst et al. ..... 702/62
2005/0005619 A1 * 1/2005 Kojima et al. ..... 62/132
2005/0284161 A1 * 12/2005 Yum et al. ..... 62/180
2007/0012052 A1 * 1/2007 Butler et al. ..... 62/181
2008/0142607 A1 * 6/2008 Yoshii et al. ..... 236/51

* cited by examiner

*Primary Examiner* — Michael D Masinick
(74) *Attorney, Agent, or Firm* — KED & Associates, LLP

(57) ABSTRACT

An air conditioner and an associated control method are provided in which performance of one or more indoor units may be adapted so as to minimize power consumption while maintaining cooling/heating effectiveness. The method may include receiving electric power related information, determining whether a current power rate included in the received information is higher than a preset reference value, determining a temperature distribution of at least one space to be air conditioned if the current power rate is higher than the preset reference value, and individually controlling a plurality of indoor units provided to the at least one spaced based on the determined temperature distribution.

25 Claims, 7 Drawing Sheets

AIR CONDITIONER AND METHOD FOR CONTROLLING THE SAME

BACKGROUND

1. Field

This relates to an air conditioner and a method for controlling the same.

2. Background

An air conditioner may supply heated or cooled air to a designated space to adjust a temperature of the space, and may also clean/humidify the air in the space. The air conditioner may include indoor and outdoor heat exchangers, a fan, and a compressor which may consume a relatively large amount of power.

BRIEF DESCRIPTION OF THE DRAWINGS

The embodiments will be described in detail with reference to the following drawings in which like reference numerals refer to like elements wherein.

DETAILED DESCRIPTION

In view of saving energy and associated cost, a smart grid may make an effective use of power. Basically, the smart grid may be employed together with a variable power rate system in which the power rate may vary based on power demands. Under such a variable power rate system, the power rate per unit time period may increase substantially in a time period in which the power demand is great (i.e., a peak period), and the power rate per unit time period may be lower in a time period in which the power demand is relatively low (i.e., a non-peak period). Because an air conditioner consumes a relatively large amount of power, the air conditioner may be controlled based on the variable power rate to reduce power consumption and related operating costs of the air conditioner.

Figure 1:
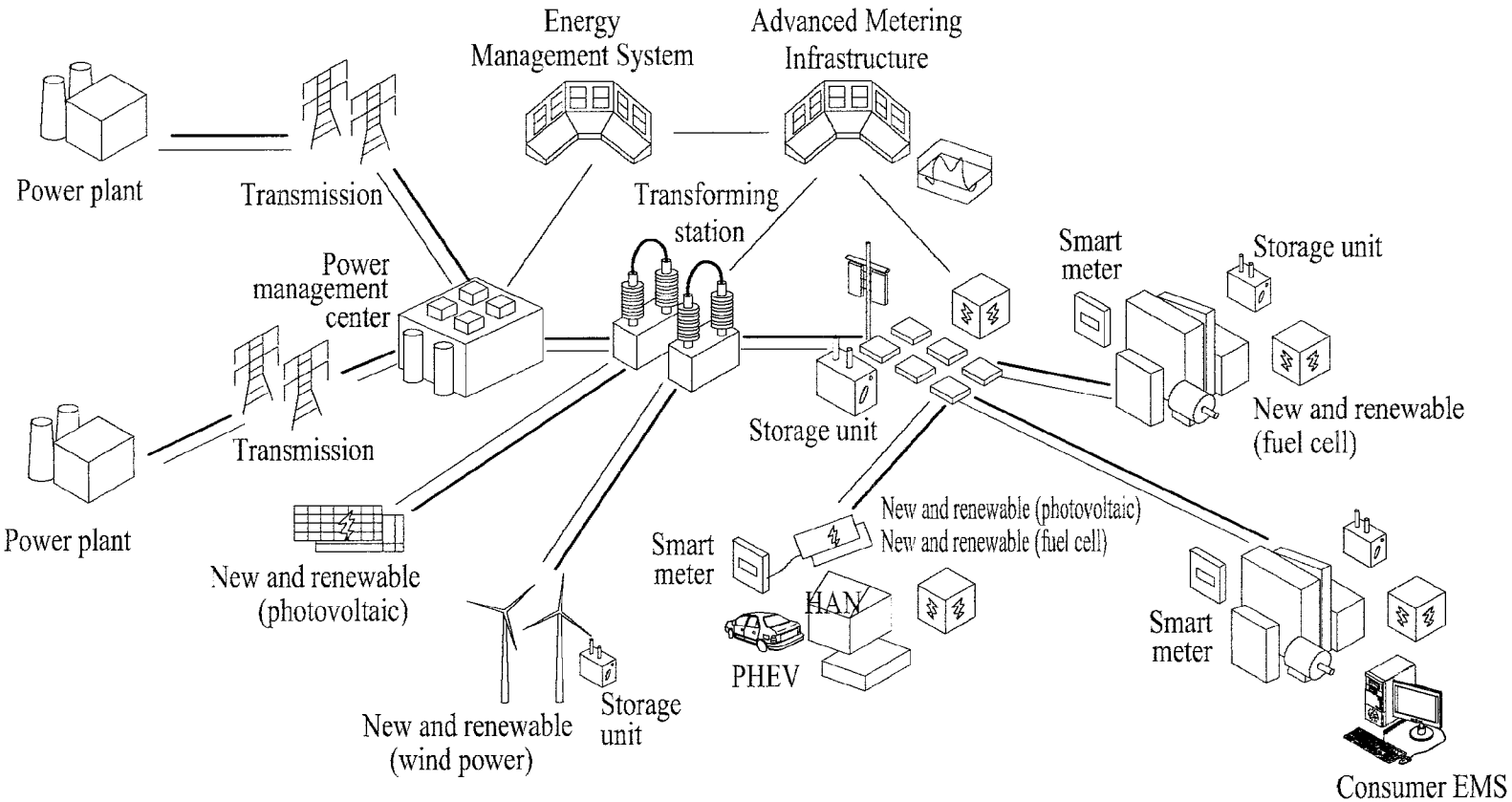
FIG. 1 is a schematic view of an exemplary smart grid.

As shown in FIG. 1, a smart grid may include conventional electric power plants that generate electric power by means of thermal power generation, nuclear power generation, or hydraulic power generation, and solar photovoltaic power generation plants and wind power plants which use renewable energy sources such as solar photovoltaic power or wind power.

The conventional electric power plant may transmit electric power to a power management center, and the power management center may transmit the electric power to a transforming station, and therefrom to consumer facilities, such as homes, offices, factories and the like. The electric power produced from the new and renewable energy sources may also transmitted to the transforming station and distributed therefrom to the consumers. In such an electric power distribution system, the electric power may be distributed from the transforming station to the offices or homes through electric power storage devices.

A home in a HAN (Home Area Network) may also produce and supply electric power for itself by means of, for example, solar photovoltaic power, which is renewable energy, or a fuel cell that may be, for example, part of a PHEV (Plug in Hybrid Electric Vehicle), and may sell any unused electric power back to the power plants. The offices or the homes may have measuring devices (hereafter referred to as smart meters) that measure electric power and power rates being used in real time, allowing consumers to adapt usage so as to reduce power consumption or cost (based on power rates) according to the present situation. This bidirectional communication between the power plants, the power management center, the storage devices, and the consumers, allows the consumers to have electric power supplied thereto in one direction, and may also provide consumer information to the storage devices, the power management center, and the power plants so that electric power production and electric power distribution may be performed based on needs of the consumers.

The smart grid may include an EMS (Energy Management System) for real time consumer electric power management and real time forecasting of power demand, and an AMI (Advanced Metering Infrastructure) for real time measurement of electric power consumption. The EMS and AMI play central roles in the smart grid. The AMI, which is based on an open architecture, allows the consumer to use electric power efficiently, and allows the electric power provider to efficiently detect system problems for managing the system. Different from a general communication network, the open architecture allows electric appliances under the control of one consumer, such as, for example, all of the domestic appliances in one home, to be connected to one another within the smart grid regardless of individual (different) manufacturers thereof. Therefore, the AMI used in the smart grid makes consumer friendly concepts and functions, such as "Prices to Devices" possible.

It is noted that, simply for ease of discussion, the consumer facility will be assumed to be a home, and the electric appliances to be managed by the smart grid will be electric household/domestic appliances. However, it is well understood that the principles and concepts set forth herein may be applied to numerous different types of consumer facilities (offices, factories, stores, schools and the like) and associated electric devices used therein.

In more detail, information related to electric power (hereafter, electric power information), particularly, the power rate information which varies with a total demand, is provided to the EMS (Energy Management System or Energy Management Server) and the smart meter provided at each consumer facility from elements of the smart grid positioned outside of the facilities. Moreover, the EMS and the smart meter provided in, for example, each home, may communicate with the electric appliances in the home and may be provided with information on power consumption from the appliances.

If such information exchange is taken into account, the electric power information may be defined such that the electric power information includes wattage supplied to the home and the variable power rate provided by the power plants and the power management center (external electric power information), and the used wattage measured in relation to the domestic appliances in the home and the actual power rates to be charged based on the used wattage (internal electric power information). Furthermore, since the supplied wattage and the power rates are provided from elements of the smart grid outside of the home, the supplied wattage and the power rates may be defined as "external power rates". Since used wattage and the actual power rates to be charged are provided from elements of the smart grid in the home, the used wattage and the power rates to be charged may be defined as "internal power rates". Therefore, it may be assumed that the electric power information to be treated in the home under the smart grid includes the external electric power information and the internal electric power information. The smart meter receives or measures the external and the internal electric power information, and the EMS provides the received or measured electric power information to the user, and can control the appliances based on the electric power information. These definitions will be applied to the description of embodiments presented hereinafter.

Overall electric power information is provided to the user through the EMS and the smart meter, and the user may manually control the domestic appliances based on the electric power information to save electric power and expenses related thereto. In more detail, based on the electric power information provided by the EMS and the smart meter, the user may apply an operational order to the appliances directly, or indirectly, through the EMS. Also, based on received electric power information, the EMS may control the appliances automatically based on a preset control method for saving energy and expenses related thereto. That is, the EMS and the smart meter may serve as a central controller (that is, a server) for integrated management of the appliances based on the received electric power information.

The domestic appliances may each include controllers for receiving instructions and appliance operation related information from an external source and controlling operation of the domestic appliances based on the instructions and the information. If the EMS and the smart meter are provided to the home, the controller of the domestic appliance may receive an instruction from the EMS, in addition to the instruction provided by the user directly, for controlling the domestic appliance. Furthermore, the domestic appliance may include functions of the EMS and the smart meter, in that the domestic appliance may measure the internal electric power information, receive the external electric power information, provide the measured and received electric power information to the user, and control the domestic appliance based on the measured and received electric power information. That is, the EMS and the smart meter may be integrated with each of the domestic appliances, or may be physically integrated with the controller of the domestic appliance. In such a case, each of the domestic appliances may be a standalone device which may directly interact with the elements of the smart grid existing outside of the home. Moreover, the domestic appliance may include a smart controlling device having all of the electric power management and control functions described before, or the controller of the domestic appliance itself may be the smart controlling device, or the domestic appliance may be connected to a central controller controlling such functions for one or more appliance.

As described before, since real time communication between the suppliers and the consumers is provided by the smart grid, "a demand response" which controls the consumer's use of electric power in response to variable power rates may be achieved. And, since the use of electric power may be controlled properly and actively, the smart grid allows the electric power company to meet peak consumer demand for electric power supply at reduced cost.

Figure 2:
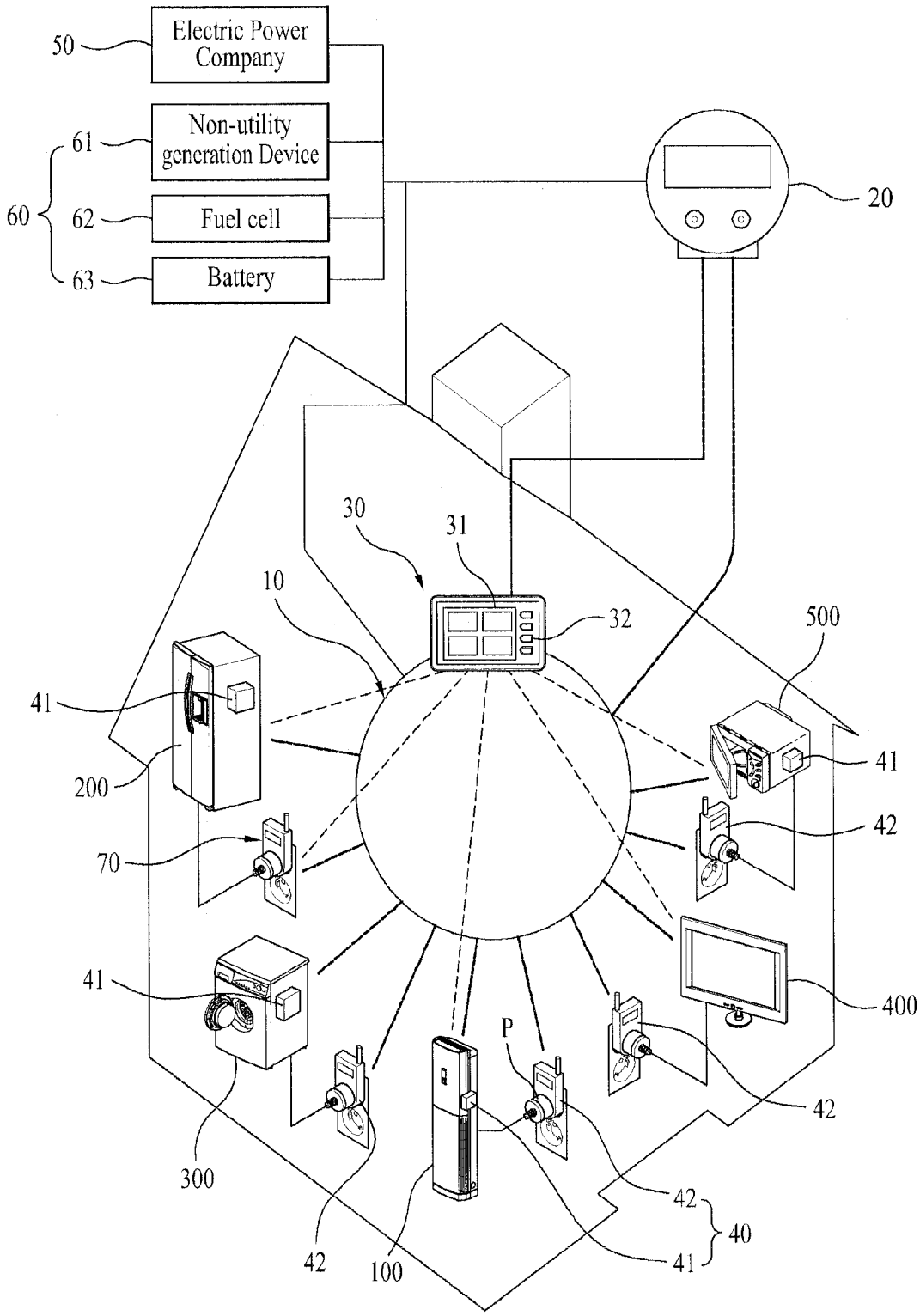
FIG. 2 is a schematic view of an exemplary electric power management network.

As shown in FIG. 2, the electric power management network 10 may include a smart meter 20 that receives electric power information, such as wattage supplied to each home and power rates from other elements of the smart grid outside of the home, and that measures, in real time, used wattage in the home and the associated power rates to be charged. In this instance, the power rate may be provided as an hourly rate, and the hourly rate may be relatively high in a time period in which use of electric power rises sharply, and may be relatively low in a time period when the use of the electric power is relatively low.

The electric power management network 10 may have an energy management system (EMS) 30 connected to the smart meter 20 for receiving electric power related information and controlling the domestic appliances while also communicating with one or more than one of the domestic appliances. The EMS 30 may be, for example, a terminal having a display 31 for displaying information, such as the electric power information, the currently used wattage and the current power rates, an outdoor environment (temperature and humidity), and an input device 32 for receiving user input. The EMS 30 may be connected to one or more domestic appliances, such as an air conditioner 100, a refrigerator 200, a washing machine and dryer 300, a television set 400, and a cooker 500, through the home network so as to have bidirectional communication with the domestic appliances. The communication in the home may be made by radio or wired communication, such as, for example, power line communication (PLC). The domestic appliances may also be connected to make other modes of communication possible. The EMS 30 and the smart meter 20 may be individual units as shown in FIG. 2, or may be integrated into one unit which performs all of the functions described above.

Figure 3:
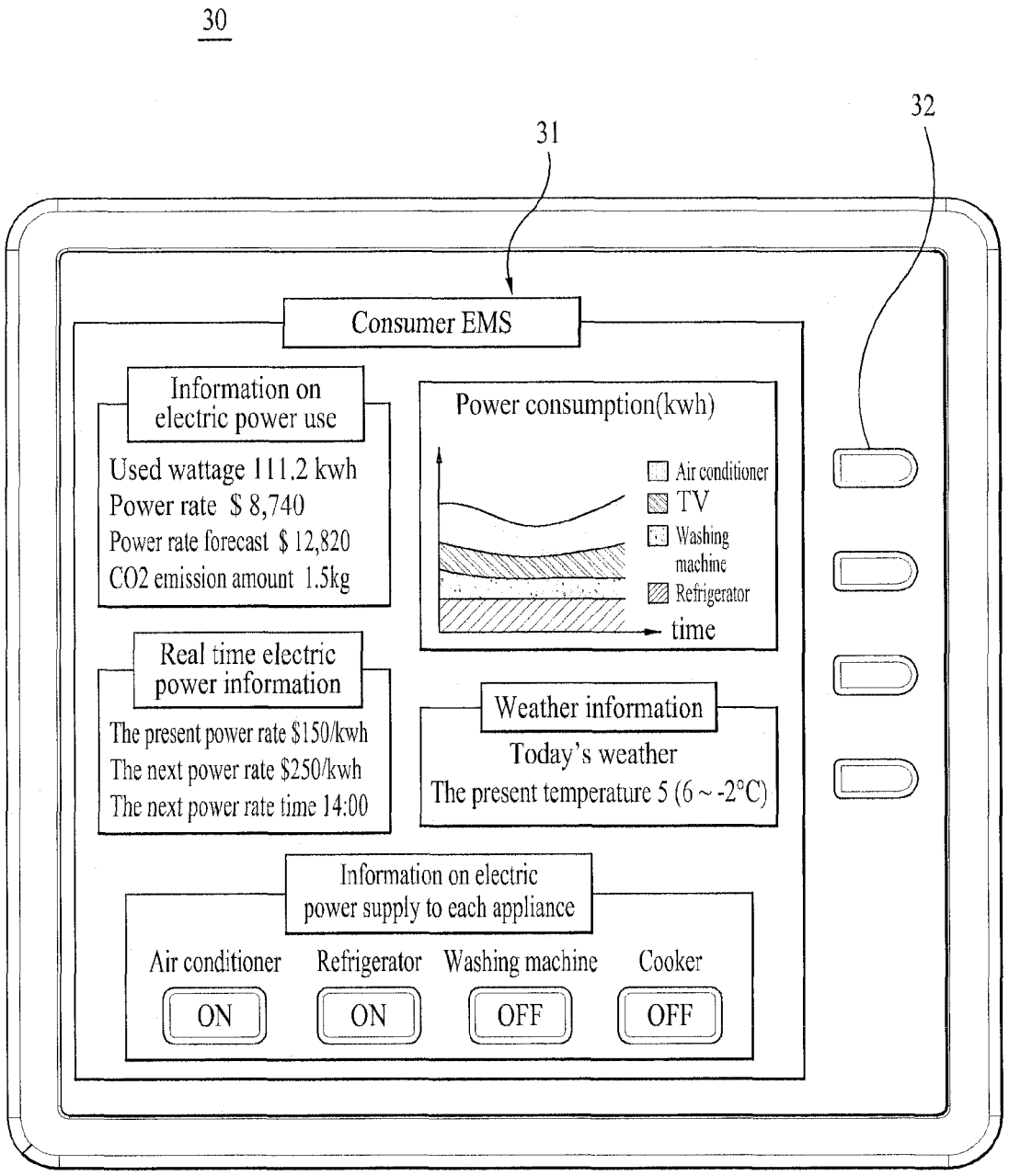
FIG. 3 is a front view of an exemplary energy management system shown in FIG. 2.

As shown in FIG. 3, the EMS 30 may include the display 31 which may display the used wattage information, such as the present used wattage, an estimated power rate and an amount of carbon dioxide emission with reference to an accumulated history, real time electric power information, such as the power rate of the present time period, the power rate of the next time period, and a time when the power rate changes, and weather information. The display 31 may also display graphs showing electric power consumption of each of the domestic appliances in each time period and changes thereof, and on/off states of each of the domestic appliances.

The display 31 may include an input device 32 that allows the user to set operation of the domestic appliances as the user requires. For example, the user may limit the allowable wattage or the power rates, and the EMS 30 may control operation of each of the domestic appliances according to the limits set by the user.

Moreover, as described above, each of the domestic appliances 100~500 may have a smart controller 40 having all of the electric power management and control functions of the smart meter and the EMS. The smart controller 40 may be provided to each home together with the smart meter 20 and the EMS 30. Moreover, since the smart meter 20/the EMS 30 and the smart controller 40 may perform substantially the same functions independent from one another, the smart controller 40 may be provided to the home without the smart meter 20 and the EMS 30, or only the smart meter 20 and the EMS 30 may be provided to the home without the smart controller 40. Each of the domestic appliances may be selectively controlled by the smart controller 40 and/or the EMS 30 based on the electric power information. If only the smart controller 40 is provided, the smart controller 40 may perform all of the functions of the smart meter 20 and the EMS 30.

The smart controller 40 may be an integrated controller 41 integrated into each of the individual domestic appliances. An integrated controller 41 may be attached to each of the domestic appliances, either on an outside thereof, or installed within. The smart controller 40 may include a smart adapter 42 placed in a plug P of each of the domestic appliances, and in an outlet 70 in the home for receiving electric power information, such as the wattage supply and the power rates, from outside of the home by using power line communication, and may measure the used wattage and the power rates to be charged based on the used wattage from the domestic appliances. The smart adapter 42 may provide such information to the user via the display, and control operation of the domestic appliances based on the electric power information.

A source of electric power to the home may be, for example, an electric power company 50 having general electric power plants (thermal, nuclear, hydraulic, and the like), or new and renewable energy sources (photovoltaic, wind, geothermal and the like). Supplementary electric power sources 60 may also serve as power supply sources. The supplementary electric power source 60 may be, for example, a non-utility generator 61 such as photovoltaic and wind power stations, or a fuel cell 62 in the home or a vehicle, or a battery 63 which may hold electric power produced from the non-utility generator 61 as a charge therein.

In general, the supplementary electric power sources 60 provide the electric power information, such as produced wattage, and charged wattage, to the smart meter 20 and the EMS 30. However, if the smart controller 40 is provided in the home, the electric power information described above may be provided to the smart controller 40 directly.

Figure 4:
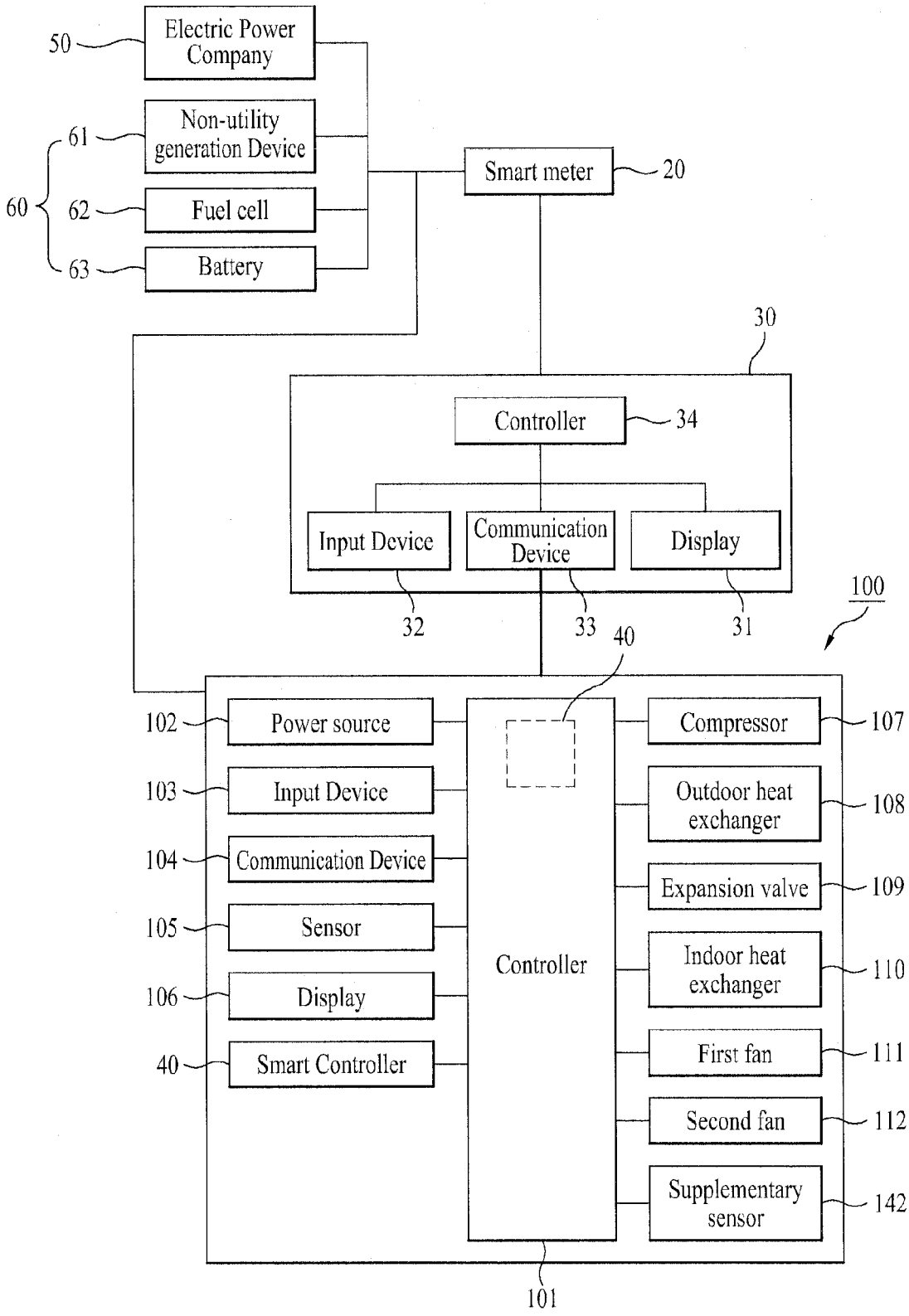
FIG. 4 is a block diagram of a power management network having an air conditioner connected thereto.
Figure 5:
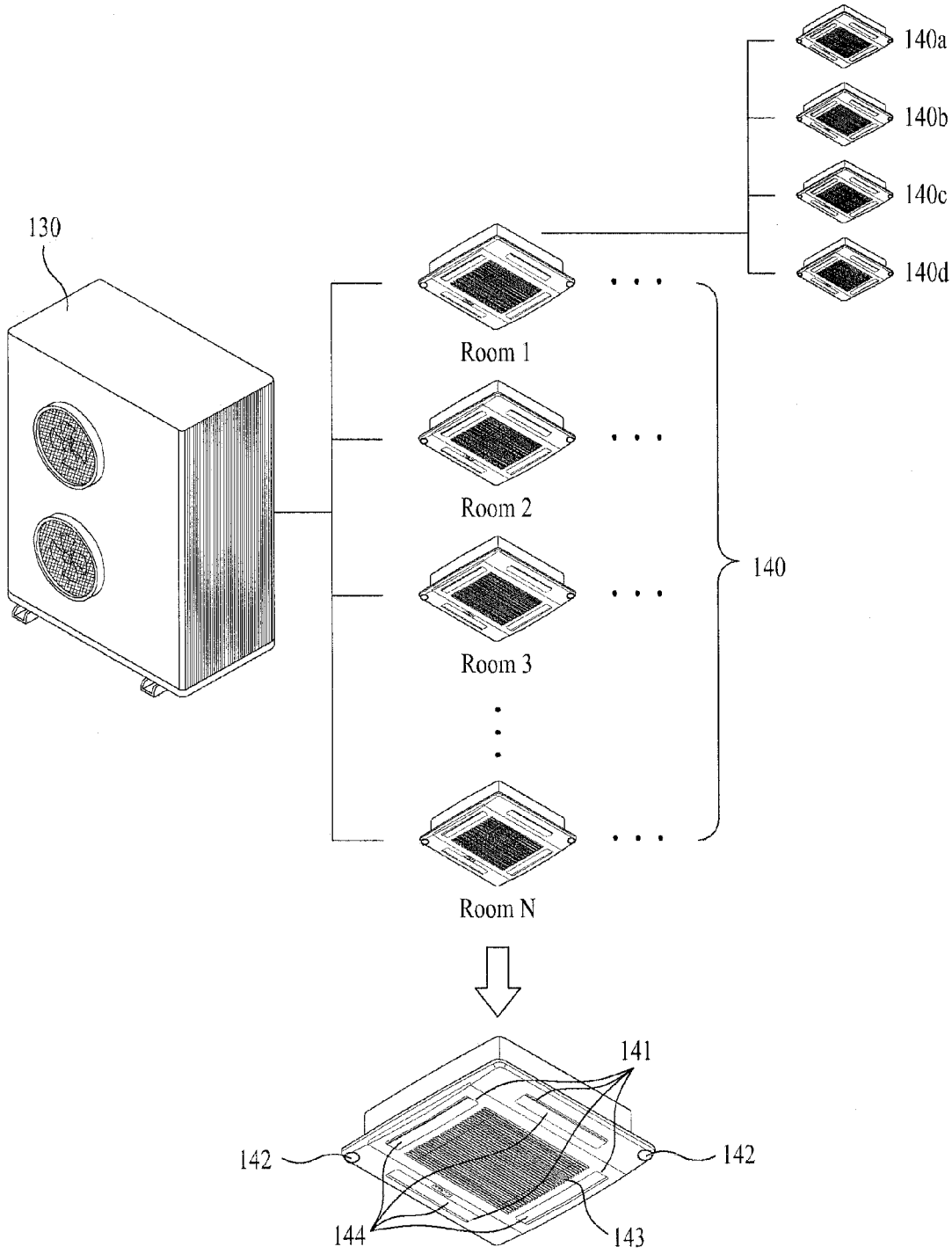
FIG. 5 illustrates an air conditioner in accordance with an embodiment as broadly described herein.

FIG. 4 is a block diagram of a domestic power management network implemented with a smart grid, and an air conditioner connected thereto, and FIG. 5 illustrates an air conditioner in accordance with an embodiment as broadly described herein.

Referring to FIG. 4, the electric power supply source may be the electric power company 50 and/or the supplementary electric power sources 60 as described above. The electric power supply source may be connected to the smart meter 20 and/or the energy management system 30, and optionally, to the smart controller 40 directly connected to the air conditioner 100 to provide for communication therewith. The functions of the power supply source and the smart meter 20 have been described in detail above.

The energy management system 30 may include a display 31, an input device 32, a communication device 33, and a controller 34.

The display 31 is substantially the same as the display 31 discussed above with respect to FIG. 3. The display 31 may display information using a UI (User Interface) or a GUI (Graphic User Interface), and may include a liquid crystal display LCD, a thin film transistor-liquid crystal display TFT LCD, an organic light-emitting diode OLED, a flexible display, or a 3D display. The display 31 may also include a touch screen that may serve as the input device 32. The display 31 may also have a module for generating an audio signal to provide an audible indicator of various events.

The input device 32 may include a key pad, a direction key, a dome switch, a touch pad (fixed voltage/static electricity), a jog wheel, a jog switch, and other such features.

The communication device 33 may communicate with the domestic appliances, including, for example, the air conditioner, and other peripheral devices as appropriate. That is, the communication device 33 may include a receiver for receiving the external and internal electric power information, and other information, and a transmitter for transmitting a control signal based on the received information and other pieces of information. The communication device 33 may have a long range communication module or a short range communication module. The long range communication module may have a module that provides wired/wireless Internet access. WLAN (Wireless LAN) (Wi-Fi), Wibro (Wireless broadband), Wimax (World Interoperability for Microwave Access), HSDPA (High Speed Downlink Packet Access), and other such technologies may provide the wireless Internet technology. RFID (Radio Frequency Identification), IrDA (Infrared Data Association), the UWB (Ultra Wideband), and ZigBee may be used for the short range communication module.

The controller 34 controls operation of the display 31, the input device, and the communication device 33. Moreover, the controller 34 may also control the domestic appliances, including the air conditioner 100, based on instructions received by the input device 32. In alternative embodiments, the controller 34 may control the domestic appliances in accordance with a preset control method based on the electric power information and other different pieces of information. The configuration of the energy management system 30 may be applied to the smart controller 40 and the smart meter 20 in a similar fashion.

As described with reference to FIG. 2, the air conditioner 100 may be connected to the electric power supply sources 50 and 60, the smart meter 20, and the energy management system 30 to interact therewith. The air conditioner 100 may include a controller 101 that receives instructions and operation related information transmitted to the air conditioner 100 so as to control operation of the air conditioner 100. The controller 101 may also receive instructions from the energy management system 30. The smart controller 40 may be provided as a part of the air conditioner 100 and the air conditioner 100 may receive instructions directly from the smart controller 40. Alternatively, as shown in a dashed square, the smart controller 40 may be physically integrated with the controller 101 into one microprocessor, as a so called smart chip, such that the controller 101 itself becomes the smart controller 40.

Thus, in certain embodiments, the controller 101, i.e., the integrated smart controller 40, can perform all of the functions of the smart meter 20 and the energy management system 30 described above, with a single device. That is, the controller 101 may measure the used wattage and costs incurred based on the power rates and used wattage, may receive the wattage and the power rates, and may provide the received and measured information to the user. The controller 101 may also directly control the operation of the domestic appliance in accordance with a preset control method based on the received and measured information. Accordingly, by using the smart controller 40 or the integrated controller 101, the electric power management network 10 may be managed even without the smart meter 20 and the energy management system 30, whose functions are provided instead by these components.

The air conditioner 100 may also include a power source 102 that supplies electric power to the air conditioner 100. An input device 103 directly receives user input operational instructions, and may correspond to a control panel of the air conditioner 100. The communication device 104 connects the air conditioner 100 to other elements in the smart grid for receiving different pieces of information and instructions. The communication device 104 may include a receiver for receiving the external and internal electric power information and other different pieces of information, and a transmitter for transmitting a control signal based on the information received and other information. The communication device 104 may communicate with other elements in the smart grid in various methods similar to those discussed above with respect to the communication device 33 of the energy management system 30. A sensor 105 may sense operation related conditions, such as, for example, an operation state, a temperature, a humidity, and other such conditions of the air conditioner 100. The display 106 may include a display panel for displaying not only the operation related information of the air conditioner 100, but also different pieces of electric power information.

The air conditioner may include a compressor 107 that draws in evaporated low temperature, low pressure gaseous refrigerant, raises a pressure of the refrigerant up to a saturation pressure which is equivalent to a condensing temperature of the refrigerant, and discharges high temperature, high pressure refrigerant. In a cooling mode, an outdoor heat exchanger 108 removes heat from the gaseous refrigerant, so that the gaseous refrigerant is condensed into high temperature, high pressure liquid refrigerant, and the outdoor heat exchanger 108 is operated as a condenser in the cooling mode. In a heating mode, the outdoor heat exchanger 108 absorbs heat from the refrigerant, and serves as an evaporator in the heating mode. An expansion valve 109 converts the liquefied high temperature, high pressure refrigerant into low temperature, low pressure refrigerant. An indoor heat exchanger 110 may opposite to the outdoor heat exchanger 108. That is, in the cooling mode the indoor heat exchanger 110 serves as an evaporator, and in the heating mode, the indoor heat exchanger 110 serves as a condenser. A first fan 111 blows air to the outdoor heat exchanger 108, and a second fan 112 blows cooled or heated air toward the room space.

As shown in FIG. 5, the compressor 107, the outdoor heat exchanger 108, and the first fan 111 are housed in an outdoor unit 130, and the indoor heat exchanger 110 and the second fan 112 are housed in an indoor unit 140. Since the outdoor unit 130 emits noise, the outdoor unit 130 may be installed outdoors, while the indoor unit 140 may be installed indoors for supplying cooled or heated air directly to the room. In this embodiment the outdoor unit 130 and the indoor unit 140 are in physically separated from each other. In alternative embodiments, the outdoor unit 130 and the indoor unit 140 may be a single, integrated unit.

As shown in FIG. 5, at least one indoor unit 140 may be installed in each of the plurality of rooms. In certain embodiments, a plurality of indoor units, for example, indoor units 140*a*, 140*b*, 140*c* and 140*d* may be installed in a single room. For efficient room cooling or heating, the indoor unit 140 may be installed on a ceiling, or may be installed on a part other than the ceiling. The indoor unit 140 may include one or more outlets 141 for discharging cold or hot air to the room, and an inlet 143 for drawing in air from the room space. Rotation of second fan 112 causes a pressure difference in the indoor unit 140 to draw the air from the room space into the indoor unit 140 through the inlet 143, where the air heat exchanges with the indoor heat exchanger 110, and is supplied to the room space through the one or more outlets 141. A vane 144 may be rotatably mounted to each outlet 141 so as to set a direction of the air being discharged.

Figure 6:
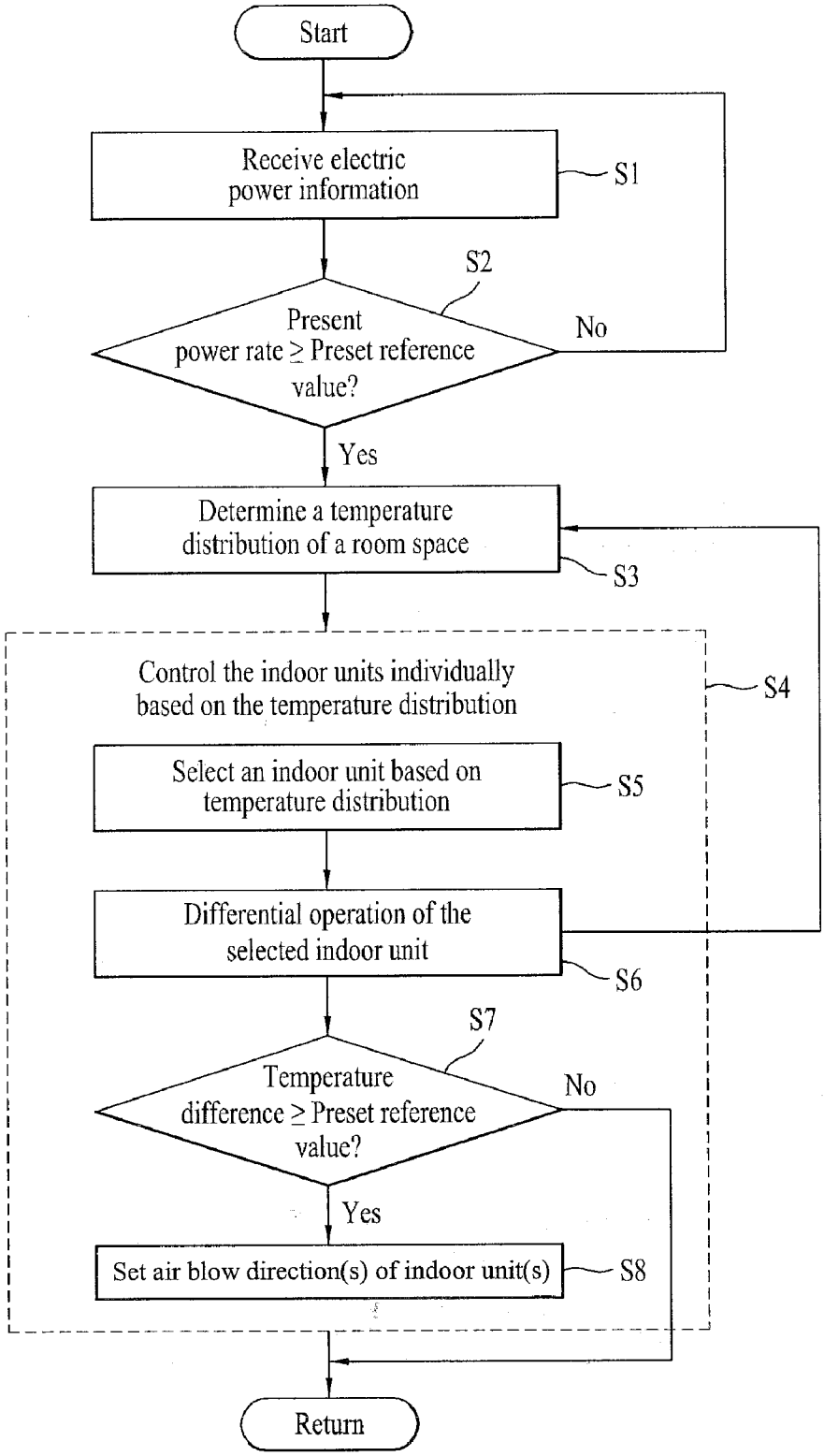
FIG. 6 illustrates a flow chart showing the steps of a method for controlling an air conditioner in accordance with a preferred example of the present application.
Figure 7:
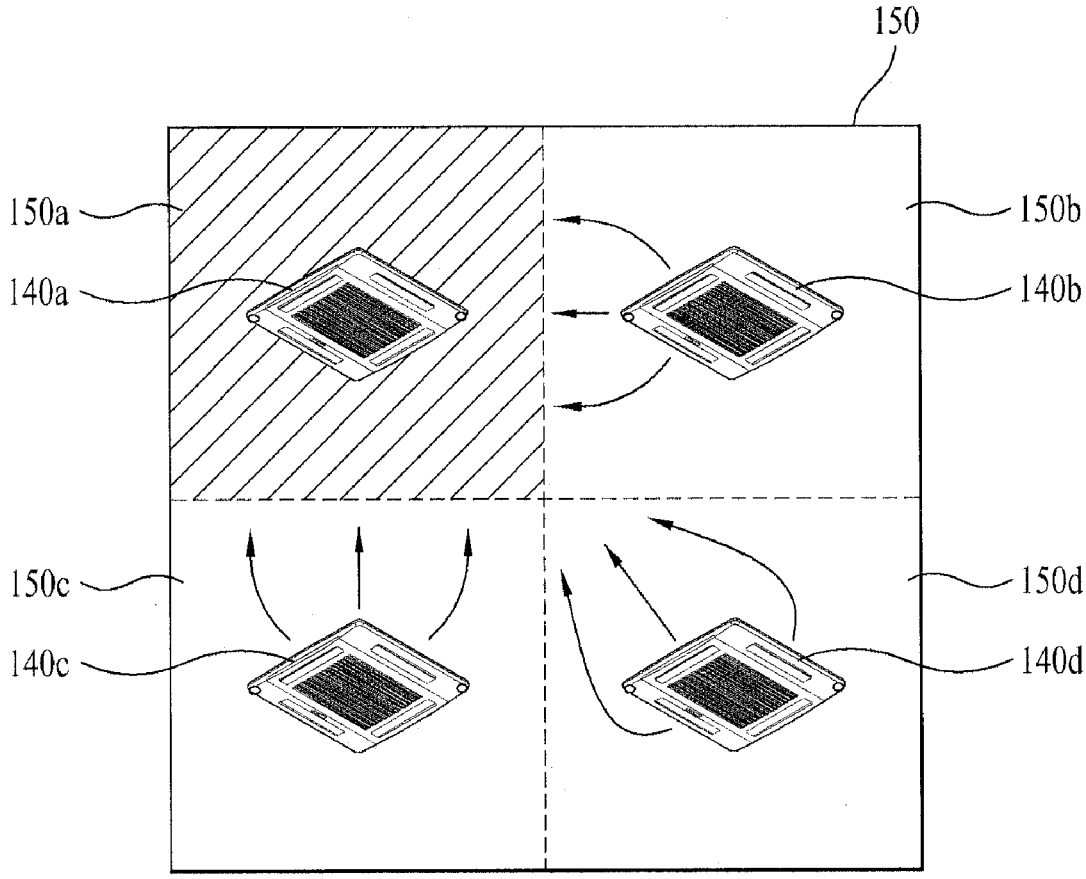
FIG. 7 illustrates a plan view of single room space having a plurality of indoor units.

FIG. 6 is a flow chart of a method for controlling an air conditioner in accordance with an embodiment as broadly described herein, and FIG. 7 is a plan view of an exemplary room space having a plurality of indoor units in which the control method shown in FIG. 6 may be employed.

It is noted that this control method may be controlled by a smart controller 40 which is a part of the domestic appliance and provided as a stand-alone device, or integrated with the controller of the domestic appliance. This control method may be performed by, not only the smart meter 20/the energy management system 30, but also a controller of the air conditioner having such capabilities.

First, the air conditioner 100 receives electric power information (S1). In particular, the smart controller 40 may receive the electric power information. In this instance, as described before, the electric power information may include the actual used wattage (including, for example, the actual wattage used by the air conditioner itself), which may be received or measured from the domestic appliances by the smart controller 40 and the power rates to be charged based on the used wattage. As the power rates significantly impact the need to suppress or restrict the use of electric power, the control of the air conditioner hereinafter will be described with reference to the power rates of the electric power information.

In more detail, at the receiving step S1, the air conditioner, and in particular the smart controller 40, receives the electric power information from the electric power company 50, including the power rates and other different pieces of information. The power rate may be a rate per a predetermined unit time period, and, as described before, may vary with total electric power demand and electric power production. In general, though the power rate per unit time period may be an hourly power rate, the predetermined unit time period may be increased or decreased as appropriate.

The electric power information may be received at the smart controller 40 in real time. The smart controller 40 may receive a table containing the electric power information for a predetermined time period. That is, the table may contain power rates per unit time period that are different from one another based on a particular predetermined time period. An electric power provider, for example, the electric power company, may forecast electric power demand and electric power production, generate a table containing power rates per unit time period for a series of time periods, i.e., a schedule, in advance, and provide the schedule to the consumers. In general, though the table may contain daily power rates per unit time period, the table may contain power rates per unit time period for longer or shorter than one day. The smart controller 40 of the air conditioner may then extract required information from the received electric power information, such as, for example, power rate information.

The air conditioner 100, and in particular, the smart controller 40, then determines whether the present power rate is higher than reference power rate or not (S2). The reference power rate may be, for example, an average of all power rates (i.e., all power rates per unit time period) for a past predetermined time period (for example, one week or one month). Alternatively, the reference power rate may be, for example, an average of relevant power rates per unit time period for a past predetermined time period. Therefore, if the present power rate is higher than the reference power rate, it indicates that the present power rate is relatively expensive. If the present power rate is lower than the reference power rate, it indicates that the present power rate is relatively inexpensive.

If it is determined that the present power rate is lower than the predetermined reference power rate, the smart controller 40 determines that the present power rate is relatively inexpensive and maintains the current operation of the air conditioner. If it is determined that the present power rate is higher than the predetermined reference power rate, the smart controller 40 determines that the present power rate is relatively expensive. In order to execute control so as to deal with the high power rate, the air conditioner 100 then determines a temperature distribution of the room space which requires air conditioning (S3).

As described above, a consumer facility, such as, for example, home, may have at least one room space (Room 1) which requires air conditioning, and, most likely, a plurality of room spaces (Room 1~Room N). Since the room spaces (Room 1~Room N) may be separated from one another by walls, floors and ceilings, an overall temperature of each of the room spaces may be different from one another. Moreover, the single room space may have temperatures therein that are different from one another, depending on location within the room. That is, sub-spaces may be formed within each of the single room spaces, and the sub-spaces may have temperatures different from one another. The temperatures of the sub-spaces may form a kind of temperature distribution in the single room space, with temperature differences expressed by gradients or contour. Therefore, knowing the temperature distribution within the single room space may help provide air conditioning to the room space more effectively.

In order to reduce power consumption (and cost) during the time period in which the power rate is relatively high, use of electric power may be suppressed or reduced. Such suppression or reduction of electric power use may be achieved by optimal control of the electric appliances while maintaining substantially the same performance of the air conditioner. However, in order to significantly reduce use of electric power, partial reduction of the performance of the air conditioner or partial restriction of the operation of the air conditioner may be required. The temperature distribution of the single room space may be considered in partial reduction or restriction of the performance or operation of the air conditioner in air conditioning the single room space. Therefore, in this control method, the temperature distribution of the single room space is determined, and operation may be performed based on the determined temperature distribution. Determination of the temperature distribution may be performed for each of the room spaces included in the home in a similar fashion as appropriate.

In determining the temperature distribution in a particular room, the air conditioner 100 first senses an air temperature around the indoor unit 140 in the room space. As described with reference to FIG. 5, a single room space may have at least one indoor unit 140, and for more effective air conditioning, may have a plurality of indoor units 140 therein. For example, as shown in FIG. 7, the single room space 150 may have four indoor units 140*a*~140*d* arranged at fixed intervals on a ceiling of the single room space 150, with the room space 150 having a plurality of sub-spaces 150*a*~150*d* corresponding to the indoor units 140*a*~140*d*. In this type of arrangement, the indoor units 140*a*~140*d* sense the temperatures around the indoor units 140*a*~140*d* within the respective sub-spaces 150*a*~150*d*, using temperature sensors 142. The air conditioner 100 may then determine the temperature distribution of the room space based on the sensed air temperatures.

In the determining step S3, a single central controller, i.e., the smart controller 40, may receive the temperatures sensed by the temperature sensors 142 at the indoor units 140*a*~140*d*, determine a temperature distribution for the room space, and perform subsequent controlling steps based on the temperature distribution. Alternatively, each of the indoor units 140*a*~140*d* may have its own individual sub-controlling device. These devices may exchange sensed temperatures with one another such that each controlling device of the indoor units 140*a*~140*d* determines the temperature distribution using the received temperatures. That is, each of the individual controlling devices of the indoor units 140*a*~140*d* may determine a common temperature distribution of the room space 150, and one of the controlling devices may perform the subsequent controlling steps using the common temperature distribution. As described before, since an air conditioner having such a distributed control system does not require mounting or setting of a central control device (the smart controller 40), such an air conditioner may be operated as soon as the air conditioner is installed in the facility.

After accurately determining the temperature distribution of the room space requiring air conditioning S3, the air conditioner 100 individually controls the plurality of indoor units 140*a*~140*d* in the room space based on the determined temperature distribution (S4).

Once a target temperature is set for the room space, all the indoor units 140*a*~140*d* in the room space may perform a preset operation until the target temperature is reached. For example, in order to reach to a target temperature that is preset for room cooling or heating, each of the indoor units 140*a*~140*d* may supply cooled or heated air, at the same temperature and flow rate, to the room space 150 for a preset time period. However, in order to achieve a more significant reduction in use of electric power during a time period having a high power rate, reduction and restriction of air conditioning performance of the air conditioner may also be taken into account. Accordingly, the air conditioner 100 may control the indoor units 140*a*~140*d* to perform differently from one another, taking the temperature distribution of the room space 150 into account. For example, the air conditioner 100 may operate at least one of the indoor units 140*a*~140*d* differently from the others. Using this differential control and differential operation, taking the temperature distribution into account, the air conditioner 100 operates the indoor units 140*a*~140*d* to yield performances different from one another. Eventually, the controlling step S4 may reduce use of electric power while maintaining an acceptable level of air conditioning performance in the room.

In more detail, in the controlling step S4, first, the air conditioner 100 selects an indoor unit for the differential control and differential operation (S5). In the selecting step S5, the air conditioner 100 may select at least one of the indoor units 140*a*~140*d* which will be operated differently from the other indoor units taking the temperature distribution into account. The air conditioner 100 may select a plurality of indoor units for the differential operation, if warranted by the temperature distribution, and may perform such differential operation consistently in subsequent controlling steps.

As shown in FIG. 7, at least one sub-space 150*a* may have a relatively higher or lower temperature than the other sub-spaces 150*b*~150*d* during a room cooling or heating operation. Therefore, the sub-space 150*a* may be air conditioned prior to the other sub-spaces 150*b*~150*d*. Based on this, in the selecting step S5, the air conditioner 100 may select at least one indoor unit positioned in a space (i.e., sub-space) having a relatively high temperature during room cooling for differential control and differential operation. Similarly, the air conditioner 100 may select at least one indoor unit positioned in a space (i.e., sub-space) having a relatively low temperature during room heating for differential control and differential operation. For example, referring to FIG. 7, in the selecting step S5, the air conditioner 100 may select the indoor unit 140*a* in the sub-space 150*a* having the relatively high temperature in room cooling or the relatively low temperature in room heating. If any one of the other sub-spaces 150*b*~150*d* (for example, the sub-space 150*b*) were to have a relatively higher temperature than the other sub-spaces 150*c* and 150*d* in room cooling, or a relatively lower temperature than the other sub-spaces 150*c* and 150*d* in room heating, the indoor unit 140*b* positioned at the sub-space 150*b* may also be selected for differential control and differential operation.

In the selecting step S5, if only a single room space and a single indoor unit is selected for differential control and differential operation, a corresponding region of the room space having a high or low temperature may be intensively and effectively cooled or heated. That is, in certain circumstances, in the selecting step S5, the air conditioner may select only the indoor unit at a region (i.e., the sub-region) of a highest temperature in room cooling for differential control and differential operation, or only the indoor unit at a region (i.e., the sub-region) of a lowest temperature in room heating for differential control and differential operation, to provide intensive cooling or heating to the targeted sub-region.

In the manner described above, the air conditioner 100 may give priority to at least one of the indoor units at a region of the room space having an unbalanced (i.e., relatively high or low) temperature, or non-uniform temperature compared to the rest of the room, for air conditioning the region to the target temperature.

After the selecting step S5, the air conditioner 100 may operate the selected indoor unit differently (S6). In the operating step S6, the air conditioner 100 may operate at least one of the plurality of indoor units 140*a*~140*d* in the room space different from the other indoor units, taking the temperature distribution into account. In more detail, the air conditioner 100 may operate at least one of the plurality of indoor units 140*a*~140*d* in the room space at a higher performance level than the other indoor units. As described before, in general, the performance of the air conditioner is based on a temperature and a flow rate of the air supplied via the indoor unit. Thus, the selected the at least one indoor unit may supply air of a lower temperature than the other indoor units in room cooling, and air of a higher temperature than the other indoor units in room heating. Similarly, the selected at least one indoor unit may supply cold air at a higher flow rate than the other indoor units in room cooling, and hot air at a higher flow rate than the other indoor units in room heating. Furthermore, the selected at least one indoor unit may supply air at a lower temperature and a higher flow rate than the other indoor units in room cooling, and at a higher temperature and a higher flow rate than the other indoor units in room heating. In addition to air temperature and flow rate, other operation conditions of the indoor units may be controlled differently from one another for differential performance. Furthermore, as described above with respect to the selecting step S5, a plurality of indoor units may be operated at a high performance level, if warranted. Indoor units not selected for differential operation may be operated at low performance levels.

Thus, in the operating step S6, the air conditioner 100 may operate at least one indoor unit at a space (i.e., the sub-space) having a relatively high temperature at a higher performance level than the other indoor units, i.e., a high cooling performance level in room cooling. Similarly, the air conditioner 100 may operate at least one indoor unit at a space (i.e., the sub-space) having a relatively low temperature at a higher performance level than the other indoor units, i.e., a high heating performance level in room heating. For example, referring to FIG. 7, the indoor unit 140*a* at the sub-space 150*a* having a relatively high temperature in room cooling or a relatively low temperature in room heating may be operated at a higher cooling performance or heating performance than the other indoor units 140*b*~140*d*. If any one of the rest of the sub-spaces 150*b*~150*d* (for example, the sub-space 150*b*) has a relatively high temperature compared to the other sub-spaces 150*c* and 150*d* in room cooling, or a relatively low temperature compared to the other sub-spaces 150*c* and 150*d* in room heating, the indoor unit 140*b* positioned at the sub-space 150*b* may be operated at a high cooling performance level or a high heating performance level in addition to the indoor unit 140*a*. The other indoor units may be operated at relatively lower performance levels.

In this manner, the air conditioner may cool down at least one area (i.e., a sub-space of the room space) having a relatively high temperature prior to the other areas in the room space in room cooling. Likewise, the air conditioner can heat at least one sub-space having a relatively low temperature prior to the other sub-spaces in room heating. Eventually, as the room space is cooled or heated effectively owing to the individual differential control of the indoor units, use of electric power may be reduced significantly while maintaining an overall comfort level in the room space.

The air conditioner 100 may control the temperature and the flow rate of the air being supplied by the individual indoor units. Since the air temperature being supplied primarily influences room air temperature, controlling the air temperature may produce a distinctive performance difference.

In such a temperature related performance control, the air conditioner 100 may first operate at least one indoor unit at a region of a relatively high temperature to supply air to the room that is colder than air supplied by the other indoor units in room cooling. Likewise, the air conditioner 100 may operate at least one indoor unit at a region of a relatively low temperature to supply air to the room that is hotter than air supplied by the other indoor units in room heating. In more detail, the indoor units not selected in room cooling or room heating may supply air at temperatures set before it was determined that the power rate is higher than the preset reference value, and the at least one selected indoor unit may supply air of a temperature lower (in room cooling) or higher (in room heating) than the set temperature. To supply different air temperatures in this manner, the selected at least one indoor unit may have a higher refrigerant flow rate than the other indoor units. That is, each of the other indoor units not selected may have lower refrigerant flow rate than the selected indoor unit. In this instance, a rotation speed of the compressor 107 connected to each of the other indoor units not selected may be reduced for supply of a relatively low refrigerant flow rate. Accordingly, the indoor heat exchanger 110 of the selected indoor unit may supply air at a relatively low or high temperature compared to the indoor units not selected due to the refrigerant having the relatively high flow rate in room cooling or room heating.

In alternative embodiments of temperature related performance control, in room cooling, at least one indoor unit at a region of relatively high temperature may supply cold air and the other indoor units may blow room temperature air. In room heating, at least one indoor unit at a region of relatively low temperature may supply hot air and the other indoor units may blow room temperature air. In general, the blowing of room temperature air may correspond at least to a supply of air having a temperature higher than the cold air being supplied in room cooling, and to a supply of air having a temperature lower than the hot air being supplied in room heating. In the air blowing step, while no refrigerant is supplied to the other indoor units not selected, only the fan, i.e., the second fan 112, is operated. Accordingly, the indoor heat exchanger 110 is not operated, and instead, the second fan 112 rotates to discharge the room air drawn through the inlet 143 through the outlet 141 at a relatively fast speed (See FIG. 5). Since such control can restrict or stop operation of the compressors 107 connected to the indoor units not selected, which require a significant amount of electric power, the electric power consumed by the air conditioner may be reduced significantly.

Performance control using an air supply flow rate may also be possible. That is, the at least one selected indoor unit may supply cold air at a higher flow rate than the other indoor units, and hot air at a higher flow rate than the other indoor units. Such an air supply flow rate may be controlled by controlling the rotation speed of the second fan 112. Furthermore, in order to maintain a certain level of air conditioning performance while reducing consumption electric power, both the temperature and air flow rate related performance controls may be applied.

The air conditioner 100 may also set an air blowing direction of each of the indoor units. In particular, the blowing direction of the other indoor units, not selected, may be directed toward the at least one selected indoor unit which is performing at a higher performance level than the other indoor units (S8). As shown in FIG. 5, the indoor unit includes the vane 144 rotatably installed in the outlet 141 for controlling an air flow direction of air discharged from the outlet 141. Accordingly, an air flow from each of the indoor units not selected may be set so as to direct toward the selected indoor unit using the vane 144 so as to cool down or heat up the space (i.e., the sub-space) having the relatively high temperature or the relatively lower temperature more quickly. For example, the indoor units not selected may supply air of a temperature higher or lower than the selected indoor unit in room cooling or room heating, or room temperature air, such that the space around the selected indoor unit is cooled down or heated up more intensively. Referring to FIG. 7, in the setting step S8, the air flow directions of the indoor units 140*b*~140*d*, which are not selected, may be set toward the selected indoor unit 140*a* for quick and intensive cooling or heating.

When temperature differences between a temperature in the area of the at least one selected indoor unit and respective temperatures in the areas of the other indoor units are distinctive, intensive and quick cooling or heating may be achieved more effectively. Accordingly, before the setting step S8, the air conditioner 100 may determine whether temperature differences between the temperature around the at least one selected indoor unit and the respective temperatures around the other indoor units are greater than a preset value (S7). By using the temperatures around the indoor units obtained in the determining step S3, the temperature differences between the temperature around the at least one selected indoor unit and the respective temperatures around the other indoor units may be calculated individually. The calculated temperature differences may then each be compared to a preset value.

The temperature differences may be indication of an extent of imbalance in the temperature distribution of the room space. That is, a relatively large temperature difference may imply a relatively large imbalance in the temperature distribution, thus requiring intensive cooling or heating for effective air conditioning. In certain embodiments, a temperature difference of 3° C. may be the preset reference value. If any one of the temperature differences is greater than the reference value, intensive cooling or heating may be performed to resolve a relatively large temperature imbalance within a relatively short time period. On the other hand, if all of the temperature differences are lower than the reference value, the temperature distribution may be relatively balanced, and the setting step S8 may not be necessary. Therefore, the setting step S8 may be selectively performed depending on the temperature differences, and intensive air conditioning may be performed more accurately for resolution of a temperature imbalance as appropriate.

After the setting step S8, the steps S3~S8 may be repeated continuously during a time period in which it is determined that the electric power rate is higher than the preset reference value in the determining step S2. Owing to such repetition, the temperature distribution of the single room space will change. That is, the continuous cooling or heating performed based on the indoor unit selection and differential operation steps S5 and S6 described above, the sub-space of the single room space initially identified as having a relatively high temperature or a relatively low temperature will change such that a different sub-space may be identified as having the relatively high/low temperature. The indoor unit selected to perform at a higher performance level than the other indoor units will also change accordingly.

For example, referring to FIG. 7, if the indoor unit 140*a* is initially operated at a relatively high performance level due to the relatively high or low temperature of the sub-space 150*a*, after a certain time period, the temperature of the sub-space 150*a* will be changed and thus the selected indoor unit/sub-space may change, and, for example, the sub-space 150*b* may instead have the relatively high or the relatively low temperature. Therefore, in order to cool or heat the sub-space 150*b* with a priority, the indoor unit 140*b* may be operated at a high performance level, while the remaining indoor units (including the indoor unit 140*a*) operate at normal or lower performance levels. Through such a series of steps, the indoor units 140*a*~140*d* may be operated at a relatively high performance level in succession, or as necessary, enabling the room space to be cooled down or heated up so as to have a uniform temperature distribution quickly while minimizing the use of electric power.

Such a successive change in the indoor unit to be operated at the high performance level may be achieved by selecting a relevant indoor unit immediately in response to a changed temperature distribution in the selecting step S5 as soon as the change in the temperature distribution is recognized. If more intensive room heating or room cooling is desired, once the at least one indoor unit is selected based on the temperature distribution, the at least one selected indoor unit may be operated to maintain a performance level that is higher than the other indoor units until the space around the selected indoor unit reaches the target temperature.

Alternatively, the at least one indoor unit may be operated to maintain a higher performance level than the other indoor units until operation of the air conditioner is stopped. Such a control is effective for continuously cooling a space around a heat source to cool down the whole room space if a particular region of the room space has an excessively high local temperature, for example, in a case in which a heat source in the room generates very high temperature. A similar control may be effective for heating a region of the room space having a low a local temperature.

As described above, the air conditioner and associated control method as embodied and broadly described herein selects a region having a relatively high or low temperature and an indoor unit corresponding to the selected region in room cooling or room heating, and improves a relative performance of the corresponding indoor unit so as to cool or heat the selected region prior to the other regions in the space, while the other indoor units are operated at relatively low performance levels. Such selection of an air conditioning space and an indoor unit and the intensive air conditioning of the selected space may effectively provide air conditioning despite what may be considered to be a lowered overall performance of the air conditioner. This restricted operation of the indoor units not selected may reduce electric power consumption, particularly in a time period having a relatively high power rate. Moreover, the active change of the indoor unit having the high performance level in response to the change of the temperature distribution allows the room space to be air conditioned within a comparatively short time period despite the low performance of some of the indoor units. Operating cost may be saved and energy efficiency may be increased without significantly impacting overall room cooling or heating.

The control method as embodied and broadly described herein may cool or heat the room space uniformly within a short time period by successive change of the high performance indoor unit based on the temperature distribution, so that a reduction of the performance of the air conditioner is not sensed by occupants of the room. Therefore, for reduction of the electric power consumption and associated operating costs, the temperature distribution determining step and the control steps S3~S8 thereafter also are applicable to a general air conditioner which is not connected to the smart grid. That is, the control steps S3~S8 may be applied to an air conditioner independent from the control steps S1~S2 which are related to the electric information provided from the smart grid.

In an air conditioner and method for controlling the same as embodied and broadly described herein, the relative improvement of performance of at least one selected indoor unit, taking the temperature distribution into account, allows cooling or heating a selected space in a single room space prior to the other spaces. Such selection of an air conditioning space and an indoor unit and intensive air conditioning of the selected space provides for effective air conditioning of the room space while reducing electric power consumption, particularly in a time period in which the power rate is relatively high, thus reducing operating cost and improving energy efficiency while maintaining performance and comfort levels in the room space.

An air conditioner and a method for controlling the same are provided.

An air conditioner and method of controlling the same conditioner are provided in which use of power is controlled properly under a variable power rate.

A method as embodied and broadly described herein may include perceiving electric power related information, determining whether the present power rate included to the perceived information is higher than a preset reference value or not, perceiving a temperature distribution of at least one of room spaces which require air conditioning if it is determined that the present power rate is higher than the preset reference value, and controlling a plurality of indoor units provided to the at least one of room spaces based on the perceived temperature distribution, individually.

Perceiving electric power related information may include the air conditioner receiving the electric power related information from an electric power company, and the electric power related information may include information on a power rate per a predetermined unit time period. Perceiving electric power related information may include the air conditioner receiving the electric power related information in real time, or in a table containing the electric power related information for a preset predetermined time period.

Perceiving a temperature distribution may include sensing temperatures of air around the indoor units in the room space, respectively, and determining a temperature distribution of the room space based on the temperatures of air sensed at the indoor units. Perceiving a temperature distribution may include a single control unit receiving the temperatures sensed at the indoor units and determining the temperature distribution of the room space. Alternatively, perceiving a temperature distribution may include controlling devices respectively provided to the indoor units exchanging the sensed temperatures with one another such that the controlling devices have the temperature distribution of the room space in common.

Controlling a plurality of indoor units may include operating at least one of a plurality of the indoor units provided to the room space different from the other indoor units, taking the perceived temperature distribution into account, and more precisely, controlling a plurality of indoor units may include operating at least one of a plurality of the indoor units provided to the room space to perform a performance higher than the other indoor units, taking the perceived temperature distribution into account.

Specifically, controlling a plurality of indoor units may include operating at least one of the indoor units in a space having a relatively high temperature to perform a performance higher than the other indoor units in room cooling, or operating at least one of the indoor units in a space having a relatively low temperature to perform a performance higher than the other indoor units in room heating. Alternatively, controlling a plurality of indoor units may include cooling at least one of spaces having a relatively high temperature prior to the other spaces in room cooling, or heating at least one of spaces having a relatively low temperature prior to the other spaces in room heating.

More specifically, controlling a plurality of indoor units may include operating at least one of the indoor units in a space having a relatively high temperature to supply air colder than the other indoor units in room cooling, or operating at least one of the indoor units in a space having a relatively low temperature to supply air hotter than the other indoor units in room heating. Or, alternatively, controlling a plurality of indoor units may include supplying cold air from at least one of the indoor units in a space having a relatively high temperature and blowing air of a room temperature from the other indoor units in room cooling, or supplying hot air from at least one of the indoor units in a space having a relatively low temperature and blowing air of a room temperature from the other indoor units in room heating. The operating step may be performed by supplying refrigerant to the other indoor units at flow rates each lower than a flow rate of the refrigerant being supplied to the at least one indoor unit, and the supplying step may include operating the fan only without supplying the refrigerant to the other indoor units.

Controlling a plurality of indoor units may include selecting at least one of the plurality of indoor units provided to the room space to be operated different from the other indoor units, taking the perceived temperature distribution into account.

The selecting step may include selecting at least one of the indoor units in a space having a relatively high temperature in room cooling, or selecting at least one of the indoor units in a space having a relatively low temperature in room heating. The selecting step may also include the step of selecting one of the indoor units in a space having a highest temperature in room cooling, or selecting one of the indoor units in a space having a lowest temperature in room heating.

Controlling a plurality of indoor units may include setting directions of air blow of the other indoor units toward the at least one of the indoor units which performs a performance higher than the other indoor units. The setting step may be performed if any one of temperature differences between a temperature of air around the at least one indoor unit and temperatures of air around the other indoor units is higher than the preset value.

The space having the relatively high temperature or the relatively low temperature may keep changing as the room cooling or room heating is kept on, and the indoor unit which performs a performance higher than the other units may keep changing with the changes in the step of controlling a plurality of indoor units.

The at least one indoor unit may be kept to maintain a performance higher than the other indoor units until a space around the at least one indoor unit reaches to a preset target temperature in the step of controlling a plurality of indoor units. Or, alternatively, the at least one indoor unit may be kept to maintain a performance higher than the other indoor units until operation of the air conditioner stops in controlling a plurality of indoor units.

In another embodiment as broadly described herein, an air conditioner may include a plurality of indoor units installed in a room space for supplying cold air, hot air, or air at a room temperature to the room space, a receiver for receiving electric power related information, a sensing unit provided to each of the indoor units for sensing temperatures around each of the indoor units respectively, and a controlling device for receiving the present power rate and the sensed temperatures from the receiver and the sensing unit respectively and controlling operation of the plurality of indoor units individually based on a temperature distribution of the room space perceived from the sensed temperatures if it is determined that the present power rate is higher than a preset reference value.

The receiver may receive the electric power related information from an electric power company, and the electric power related information may include information on a power rate per a predetermined unit time period.

The controlling device may include a single control unit for receiving the temperatures sensed at the indoor units and determining the temperature distribution of the room space. Or alternatively, the controlling device may include a plurality of controlling devices respectively provided to the indoor units for exchanging the sensed temperatures with one another such that the controlling devices have the temperature distribution of the room space in common.

The controlling device may operate at least one of the plurality of the indoor units provided to the room space different from the other indoor units, taking the perceived temperature distribution into account, and more precisely, the controlling device may operate at least one of a plurality of the indoor units provided to the room space to perform a performance higher than the other indoor units, taking the perceived temperature distribution into account.

Specifically, at least one of the indoor units in a space having a relatively high temperature may perform a performance higher than the other indoor units in room cooling, or at least one of the indoor units in a space having a relatively low temperature may perform a performance higher than the other indoor units in room heating. And, the controlling device cools down at least one of spaces having a relatively high temperature prior to the other spaces in room cooling, or heats at least one of spaces having a relatively low temperature prior to the other spaces in room heating.

More specifically, at least one of the indoor units in a space having a relatively high temperature may supply air colder than the other indoor units in room cooling, or at least one of the indoor units in a space having a relatively low temperature may supply air hotter than the other indoor units in room heating. Or alternatively, at least one of the indoor units in a space having a relatively high temperature may supply cold air and the other indoor units blow air of a room temperature in room cooling, or at least one of the indoor units in a space having a relatively low temperature may supply hot air and the other indoor units blow air of a room temperature in room heating. In those operations, the other indoor units may have refrigerant supplied thereto at flow rates each lower than a flow rate of the refrigerant being supplied to the at least one indoor unit, and the other indoor units can operate the fans only without having the refrigerant supplied thereto, respectively.

The controlling device may select at least one of the plurality of indoor units provided to the room space to be operated different from the other indoor units, taking the perceived temperature distribution into account.

More specifically, the controlling device may select at least one of the indoor units in a space having a relatively high temperature in room cooling, or selects at least one of the indoor units in a space having a relatively low temperature in room heating. And, the controlling device selects one of the indoor units in a space having a highest temperature in room cooling, or selects one of the indoor units in a space having a lowest temperature in room heating.

The other indoor units may have air blow directions set toward the at least one of the indoor units which performs a performance higher than the other indoor units. More specifically, the other indoor units may have air blow directions set toward the at least one of the indoor units if any one of temperature differences between a temperature around the at least one indoor unit and temperatures around the other indoor units is higher than a preset value.

The space having the relatively high temperature or the relatively low temperature may keep changing as the room cooling or room heating is kept on, and the indoor unit which performs a performance higher than the other units may also keep changing with the changes.

The at least one indoor unit may be kept to maintain a performance higher than the other indoor units until a space around the at least one indoor unit reaches to a preset target temperature. Or, alternatively, the at least one indoor unit may be kept to maintain a performance higher than the other indoor units until operation of the air conditioner stops.

In still another embodiment as broadly described herein, a method for controlling an air conditioner may include sensing temperatures of air around a plurality of indoor units provided to at least one of room spaces which require air conditioning respectively, perceiving a temperature distribution of the room space based on the sensed temperatures from the indoor units, and controlling the plurality of indoor units based on the perceived temperature distribution, individually.

In still another embodiment as broadly described herein, an air conditioner may include a plurality of indoor units installed in a room space for supplying cold air, hot air, or air at a room temperature to the room space, a sensing unit provided to each of the indoor units for sensing a temperature around each of the indoor units, and a controlling device for receiving the sensed temperatures from the sensing units and controlling operation of the plurality of indoor units individually based on a temperature distribution of the room space perceived from the sensed temperatures.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling an air conditioner, the method comprising:

determining whether a current power rate is greater than a preset reference power rate;

determining a temperature distribution within a room to be cooled or heated by the air conditioner if the current power rate is greater than the preset reference power rate; and independently controlling a plurality of indoor units provided in the room based on the determined temperature distribution, comprising:

partitioning the room into a plurality of regions corresponding to the plurality of indoor units;

identifying a region of the plurality of regions requiring intensive cooling or heating based on the determined temperature distribution;

identifying an indoor unit of the plurality of indoor units corresponding to the identified region; and rotating a plurality of vanes respectively provided in a plurality of outlets respectively provided in remaining indoor units of the plurality of indoor units so as to direct air discharged therefrom toward the identified region.

2. The method of claim 1, wherein determining a temperature distribution comprises sensing a plurality of localized temperatures using a plurality of sensors provided within the room, and determining the temperature distribution based on the plurality of localized temperatures sensed by the plurality of sensors.

3. The method of claim 2, wherein the plurality of sensors are provided on the plurality of indoor units such that the plurality of localized temperatures are sensed in respective areas of the plurality of indoor units.

4. The method of claim 2, wherein independently controlling a plurality of indoor units provided in the room based on the determined temperature distribution further comprises:

operating the identified indoor unit at a modified performance level based on the determined temperature distribution.

5. The method of claim 4, wherein operating the identified indoor unit at a modified performance level based on the determined temperature distribution comprises providing an increased level of cooling or heating to the room via the identified indoor unit.

6. The method of claim 5, further comprising providing a decreased level of cooling or heating to the room via the remaining indoor units of the plurality of indoor units.

7. The method of claim 4, wherein operating the identified indoor unit at a modified performance level based on the determined temperature distribution comprises operating all of the plurality of indoor units at respective modified performance levels.

8. The method of claim 7, wherein operating the identified indoor unit at a modified performance level based on the determined temperature distribution comprises:

providing air through the identified indoor unit having a temperature that is less than or equal to a cooling temperature in a cooling mode of the air conditioner, or that is greater than or equal to a heating temperature in a heating mode of the air conditioner; and operating fans of the remaining indoor units so as to recirculate air from the room through the remaining indoor units and back into the room.

9. The method of claim 8, wherein operating fans of the remaining indoor units so as to recirculate air from the room through the remaining indoor units comprises recirculating air from the room through the remaining indoor units without cooling or heating the recirculated air.

10. The method of claim 8, wherein providing air through the identified indoor unit having a temperature that is less than or equal to a cooling temperature in a cooling mode of the air conditioner, or that is greater than or equal to a heating temperature in a heating mode of the air conditioner, comprises supplying refrigerant to the identified indoor unit at a flow rate that is greater than a flow rate at which refrigerant is supplied to the remaining indoor units.

11. The method of claim 10, wherein supplying refrigerant to the identified indoor unit at a flow rate that is greater than a flow rate at which refrigerant is supplied to the remaining indoor units comprises supplying refrigerant only to the identified indoor unit, and not to the remaining indoor units.

12. The method of claim 7, wherein operating the identified indoor unit at a modified performance level based on the determined temperature distribution comprises:

providing cooled or heated air through the identified indoor unit at a first air flow rate; and providing air through the remaining indoor units at a second air flow rate that is less than the first air flow rate.

13. The method of claim 12, wherein providing cooled or heated air through the identified indoor unit at a first air flow rate, and providing air through the remaining indoor units at a second air flow rate that is less than the first air flow rate comprises rotating a fan of the identified indoor unit at a higher rotational speed than that of the fans of the remaining indoor units.

14. The method of claim 2, wherein determining a temperature distribution comprises receiving, at a single controller, the plurality of localized temperatures sensed by the plurality of sensors.

15. The method of claim 2, wherein each of the plurality of indoor units includes a respective local controller provided therewith, and wherein determining a temperature distribution comprises each of the local controllers exchanging the sensed localized temperatures with one another such that a common temperature distribution is generated at each of the local controllers.

16. The method of claim 1, further comprising receiving electric power related information from an external electric power source, the electric power information including the current power rate.

17. The method of claim 1, wherein receiving electric power related information comprises the air conditioner receiving the electric power related information in real time, or in a table containing the electric power related information for a preset predetermined time period.

18. The method of claim 1, wherein individually controlling a plurality of indoor units comprises setting blowing directions of air discharged from the plurality of indoor units so as to direct the air discharged therefrom toward one of the plurality of indoor units.

19. An air conditioning system, comprising:

a plurality of indoor units installed in a room so as to supply cooled air, heated air, or room temperature air to the room;

a receiver for receiving electric power related information;

a sensor provided with each of the plurality of indoor units for sensing temperatures around each of the plurality of indoor units, respectively; and a controller that receives current power rate information from the receiver and sensed temperatures from the sensors, that determines a temperature distribution in the room based on the sensed temperatures, and that individually controls the plurality of indoor units based on the determined temperature distribution if the current power rate is greater than a preset reference power rate, wherein, in a cooling mode, the controller is configured to identify at least one indoor unit positioned in a region of the room having a relatively high temperature, to control the identified at least one indoor unit to supply air having a temperature that is lower than that of air supplied by remaining indoor units of the plurality of indoor units, and to set air blow directions of the remaining indoor units toward the identified at least one indoor unit, and wherein, in a heating mode, the controller is configured to identify at least one indoor unit positioned in a region of the room having a relatively low temperature, to control the identified at least one indoor unit to supply air having a temperature that is greater than that of air supplied by remaining indoor units of the plurality of indoor units, and to set air blow directions of the remaining indoor units toward the identified at least one indoor unit.

20. The air conditioner of claim 19, wherein the controller comprises a single central controller that receives the temperatures sensed by the sensors at the plurality of indoor units and determines the temperature distribution of the space room based on the sensed temperatures.

21. The air conditioner of claim 19, wherein the controller comprises a plurality of individual controllers respectively provided with the plurality of indoor units, wherein the plurality of individual controllers are configured to exchange the temperatures sensed at their respective indoor units by their respective sensors and generate a common temperature distribution of the room.

22. The air conditioner of claim 19, wherein the controller is configured to individually control the plurality of indoor units so as to cool the region of the room having the relatively high temperature prior to remaining regions of the room in the cooling mode, and to heat the region of the room having the relatively low temperature prior to remaining regions of the room in the heating mode.

23. The air conditioner of claim 19, wherein the controller is configured to operate at least one of the plurality of indoor units at a higher performance level than that of remaining indoor units of the plurality of indoor units based on the determined temperature distribution.

24. The air conditioner of claim 19, wherein the controller is configured to control the respective remaining indoor units so as to supply room temperature air to the room in the cooling mode and in the heating mode.

25. The air conditioner of claim 19, wherein, in both the cooling mode and the heating mode, the controller is configured to supply refrigerant to the at least one indoor unit at a flow rate that is greater than a flow rate of refrigerant supplied to the remaining indoor units.

* * * * *